US006673305B2

(12) United States Patent
Dunne et al.

(10) Patent No.: US 6,673,305 B2
(45) Date of Patent: Jan. 6, 2004

(54) APPARATUS FOR INJECTING GAS INTO A VESSEL

(75) Inventors: Martin Joseph Dunne, West Midland (AU); Gregory John Hardie, Tasmania (AU)

(73) Assignee: Technological Resources Pty Ltd., Melbourne (AU)

( * ) Notice: Subject to any disclaimer, the term of this patent is extended or adjusted under 35 U.S.C. 154(b) by 0 days.

(21) Appl. No.: 10/119,305

(22) Filed: Apr. 10, 2002

(65) Prior Publication Data

US 2002/0158377 A1 Oct. 31, 2002

(30) Foreign Application Priority Data

Apr. 11, 2001 (AU) ..... PR4369
Apr. 17, 2001 (AU) ..... PR4440

(51) Int. Cl.[7] ..... C21C 5/32

(52) U.S. Cl. ..... 266/225; 266/270; 266/46

(58) Field of Search ..... 266/225, 270, 266/46

(56) References Cited

U.S. PATENT DOCUMENTS 6,440,356 B2 * 8/2002 Dunne ..... 266/225

* cited by examiner

*Primary Examiner*—Melvyn Andrews
(74) *Attorney, Agent, or Firm*—Miles & Stockbridge P.C.; John C. Kerins

(57) ABSTRACT

An injection lance (26) for injecting hot gas into a vessel includes an elongate gas flow duct (31) which receives hot gas from a gas inlet structure (32) and an elongate central tubular structure (33) which extends within gas flow duct (31) from its rear end to its forward end. Adjacent the forward end of duct (31), central structure (33) carries a series of flow directing vanes (34) for imparting swirl to the hot gas flow exiting the duct. The wall of duct (31) downstream from gas inlet (32) is internally water cooled by flow of water through annular passages (43,44). The cooling water also flows through the interior of a duct tip (36) at the forward end of duct (31).

The front end of central structure (33) which carries the swirl vanes (34) is internally water cooled by cooling water supplied forwardly through a central water flow passage (52) from a water inlet (53) at the rear of the lance through to a nose (35) of the central structure. The cooling water returns back through the central structure via an annular water return passage (54) to a water outlet (55) at the rear end of the lance.

23 Claims, 4 Drawing Sheets

11
12
13
14
15
16
17
18
19
21
22
23
24
25
26
27
27
28
28

APPARATUS FOR INJECTING GAS INTO A VESSEL

BACKGROUND OF THE INVENTION

The present invention provides an apparatus for injecting gas into a vessel. It has particular, but not exclusive application to apparatus for injecting a flow of gas into a metallurgical vessel under high temperature conditions. Such metallurgical vessel may for example be a smelting vessel in which molten metal is produced by a direct smelting process.

DESCRIPTION OF RELATED ART

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. To promote effective post combustion of the gases in the upper part of the vessel, it is desirable that the incoming hot air blast exit the lance with a swirling motion. To achieve this, the outlet end of the lance may be fitted with internal flow guides to impart an appropriate swirling motion. The upper regions of the vessel may reach temperatures of the order of 2000° C. and the hot air may be delivered into the lance at temperatures of the order of 1100–1400° C. The lance must therefore be capable of withstanding extremely high temperatures both internally and on the external walls, particularly at the delivery end of the lance which projects into the combustion zone of the vessel. The present invention provides a lance construction which enables the relevant components to be internally water cooled and to operate in a very high temperature environment.

SUMMARY OF THE INVENTION

According to the invention there is provided apparatus for injecting gas into a vessel, including:

a gas flow duct extending from a rear end to a forward end from which to discharge gas from the duct;

an elongate central tubular structure extending within the gas flow duct from its rear end to its forward end;

a plurality of flow directing vanes disposed about the central tubular structure adjacent the forward end of the duct to impart swirl to a gas flow to the forward end of a duct, the forward end of the central structure and the forward end of the duct co-acting together to form an annular nozzle for flow of gas from the duct with swirl imparted by said vanes;

cooling water passages within the central tubular structure for flow of cooling water forwardly through the central structure from its rear end to its forward end and to internally cool that forward end and thence to return back through the central structure to its rear end.

The forward end of the duct may be formed as a hollow annular tip formation and the gas flow duct may include duct tip cooling water supply and return passages for supply of cooling water forwardly along the duct into the duct tip and return of that cooling water back along the duct.

The interior peripheral surface of the duct may be lined with refractory material.

Preferably the central tubular structure defines a central water flow passage for flow of water forwardly through that structure directly to the forward end of the central structure and an annular water flow passage disposed about the central passage for return flow of water from the forward end of the central structure back to the rear end of that structure.

The central tubular structure may comprise a central tube providing the central water flow passage and a further tube disposed around the central tube to define said annular water flow passage between the tubes.

Preferably the central structure includes a heat insulating outer shield to retard heat transfer from gas in the gas flow duct into the cooling water passages in the central structure.

The heat insulating shield may be comprised of a plurality of tubular segments of heat insulating material disposed end to end to form the heat shield as a substantially continuous tube extending from the rear end to the front end of the central structure about an annular air gap disposed immediately within the heat shield.

Said air gap may be formed between the tubular heat shield and the further tube defining the outer wall of the annular water return flow passage.

Preferably said tubular segments of the heat shield are supported to accommodate longitudinal expansion of each segment independently of the other such segments.

The forward end of the central structure may include a domed nose portion provided internally with a single spiral cooling water passage to receive water from the central water flow passage in the central structure at the tip of the nose and direct that water in a single flow around and backwardly along the nose to cool the nose with a single coherent stream of cooling water.

The apparatus may include a gas inlet for introduction of hot gas into the rear end of the duct, the gas inlet comprising a refractory body defining a first tubular gas passage aligned with and extending directly to the rear end of the duct and a second tubular gas passage transverse to the first passage to receive hot gas and direct it to the first passage so that the hot gas and any particles entrained therein impinge on refractory wall of the first passage, the gas flow undergoing a change of direction in passing from the first passage to the second passage.

The first and second gas flow passages may be essentially normal to one another.

The central tubular structure may extend centrally through the first gas flow passage of the gas inlet means and rearwardly beyond the gas inlet. The rear end of the central structure may then be located rearwardly of the gas inlet and be provided with water couplings for the flow of cooling water to and from the central structure.

The invention also provides apparatus for injecting gas into a vessel, including:

a gas flow duct extending from a rear end to a forward end from which to discharge gas from the duct;

an elongate structure extending centrally within the forward end of the duct such that gas flowing through the forward end of the duct will flow over and along the central structure;

a plurality of flow directing vanes disposed about the central structure adjacent the forward end of the duct to impart swirl to a gas flow to the forward end of a duct, the forward end of the central structure and the forward end of the duct co-acting together to form an annular nozzle for flow of gas from the duct with swirl imparted by said vanes; and a cooling water passage within the central structure for flow of cooling water forwardly to its forward end and to internally cool that forward end;

wherein the forward end of the central structure includes a domed nose portion provided internally with a single spiral cooling water passage to receive water from the central water flow passage in the central structure at the tip of the nose and direct that water in a single flow around and backwardly along the nose to cool the nose with a single coherent stream of cooling water.

The invention further provides apparatus for injecting gas into a vessel, including:

a gas flow duct extending from a rear end to a forward end from which to discharge gas from the duct;

an elongate structure extending centrally within the forward end of the gas flow duct such that gas flowing through the forward end of the duct will flow over and along the central structure;

a plurality of flow directing vanes disposed about the central tubular structure adjacent the forward end of the duct to impart swirl to a gas flowing to the forward end of a duct, the forward end of the central structure and the forward end of the duct co-acting together to form an annular nozzle for flow of gas from the duct with swirl imparted by said vanes;

cooling water passages within the wall of the duct and the central structure for water cooling both the duct and the central structure; and a gas inlet for introduction of hot gas into the rear end of the duct, the gas inlet comprising a refractory body defining a first tubular gas passage aligned with and extending directly to the rear end of the duct and a second tubular gas passage transverse to the first passage to receive hot gas and direct it to the first passage so that the hot gas and any particles entrained therein impinge on refractory wall of the first passage, the gas flow undergoing a change of direction in passing from the first passage to the second passage.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

Figure 1:
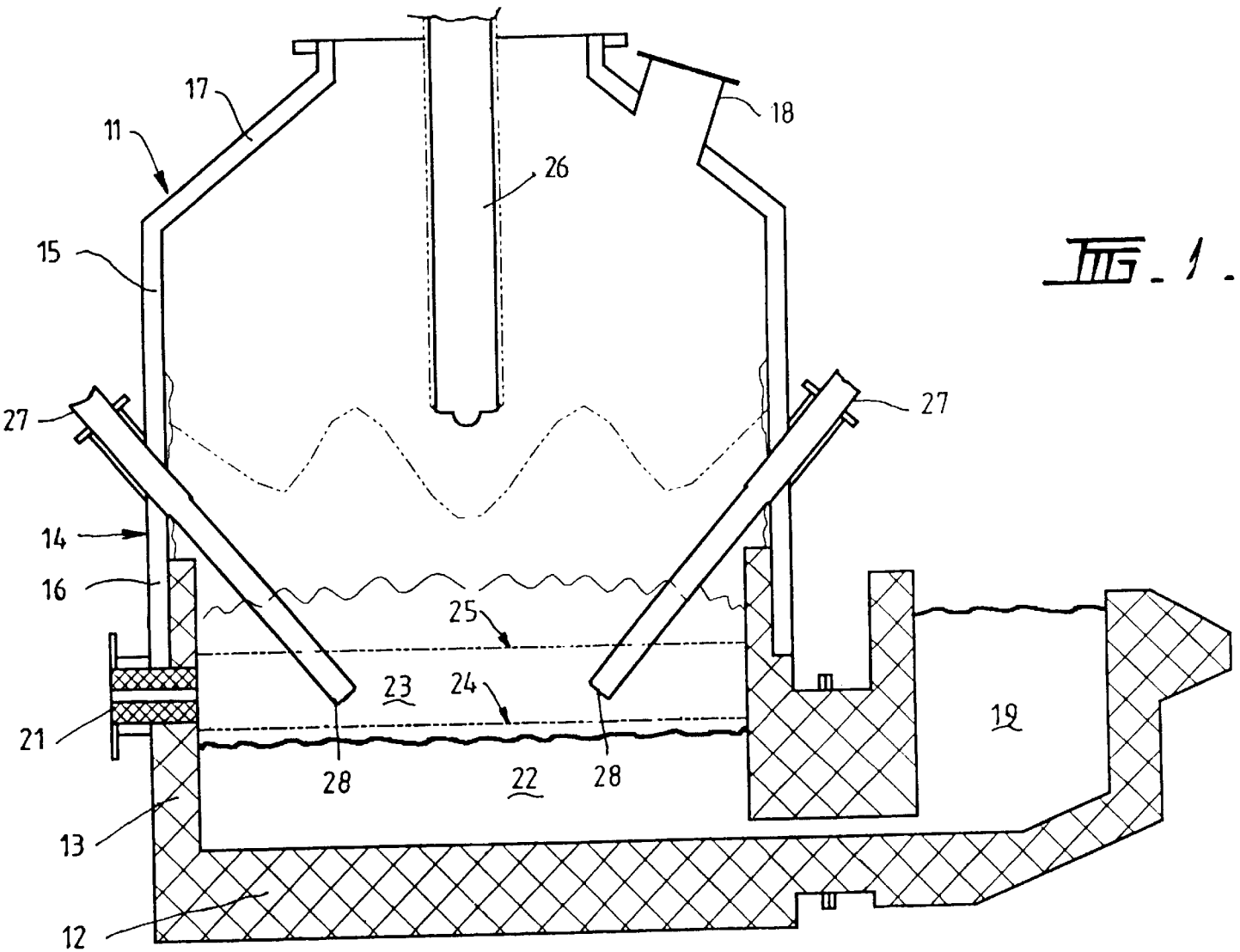
FIG. 1 is a vertical section through a direct smelting vessel incorporating a pair of solids injection lances and a hot air blast injection lance constructed in accordance with the invention.
Figures 2, 3:
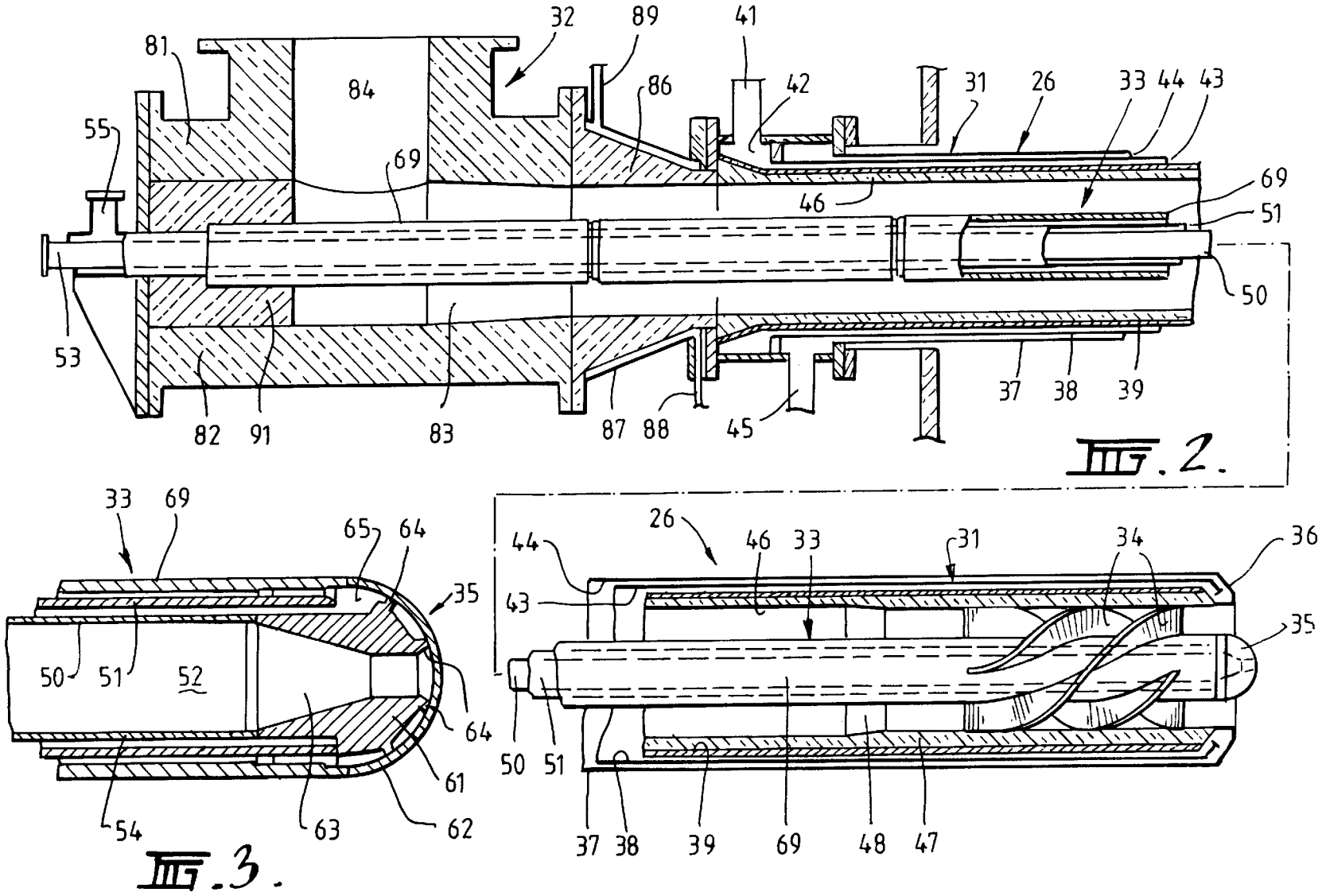
FIG. 2 is a longitudinal cross-section through the hot air injection lance.
FIG. 3 is a longitudinal cross-section to an enlarged scale through a front part of a central structure of the lance.

FIG. 1 illustrates a direct smelting vessel suitable for operation by the HIsmelt process as described in International Patent Application PCT/AU96/00197. The metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 15 and a lower barrel section 16; a roof 17; an outlet 18 for off-gases; a forehearth 19 for discharging molten metal continuously; and a tap-hole 21 for discharging molten slag.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a hot air blast into an upper region of the vessel and two solids injection lances 27 extending downwardly and inwardly through the side walls 14 and into the slag layer 23 for injecting iron ore, solid carbonaceous material, and fluxes entrained in an oxygen-deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

The construction of the hot air injection lance 26 is illustrated in FIGS. 2–10. As shown in these figures lance 26 comprises an elongate duct 31 which receives hot gas through a gas inlet structure 32 and injects it into the upper region of vessel. The lance includes an elongate central tubular structure 33 which extends within the gas flow duct 31 from its rear end to its forward end. Adjacent the forward end of the duct, central structure 33 carries a series of four swirl imparting vanes 34 for imparting swirl to the gas flow exiting the duct. The forward end of central structure 33 has a domed nose 35 which projects forwardly beyond the tip 36 of duct 31 so that the forward end of the central body and the duct tipped tip co-act together to form an annular nozzle for divergent flow of gas from the duct with swirl imparted by the vanes 34. Vanes 34 are disposed in a four-start helical formation and are a sliding fit within the forward end of the duct.

The wall of the main part of duct 31 extending downstream from the gas inlet 32 is internally water cooled. This section of the duct is comprised of a series of three concentric steel tubes 37, 38, 39 extending to the forward end part of the duct where they are connected to the duct tip 36. The duct tip 36 is of hollow annular formation and it is internally water cooled by cooling water supplied and returned through passages in the wall of duct 31. Specifically, cooling water is supplied through an inlet 41 and annular inlet manifold 42 into an inner annular water flow passage 43 defined between the tubes 38, 39 of the duct through to the hollow interior of the duct tip 36 through circumferentially spaced openings in the tip. Water is returned from the tip through circumferentially spaced openings into an outer annular water return flow passage 44 defined between the tubes 37, 38 and backwardly to a water outlet 45 at the rear end of the water cooled section of duct 31.

The water cooled section of duct 31 is internally lined with an internal refractory lining 46 that fits within the innermost metal tube 39 of the duct and extends through to the water cooled tip 36 of the duct. The inner periphery of duct tip 36 is generally flush with the inner surface of the refractory lining which defines the effective flow passage for gas through the duct. The forward end of the refractory lining has a slightly reduced diameter section 47 which receives the swirl vanes 34 with a snug sliding fit. Rearwardly from section 47 the refractory lining is of slightly greater diameter to enable the central structure 33 to be inserted downwardly through the duct on assembly of the lance until the swirl vanes 34 reach the forward end of the duct where they are guided into snug engagement with refractory section 47 by a tapered refractory land 48 which locates and guides the vanes into the refractory section 47.

The front end of central structure 33 which carries the swirl vanes 34 is internally water cooled by cooling water supplied forwardly through the central structure from the rear end to the forward end of the lance and then returned back along the central structure to the rear end of the lance. This enables a very strong flow of cooling water directly to the forward end of the central structure and to the domed nose 35 in particular which is subjected to very high heat flux in operation of the lance.

Central structure 33 comprises inner and outer concentric steel tubes 50, 51 formed by tube segments, disposed end to end and welded together. Inner tube 50 defines a central water flow passage 52 through which water flows forwardly through the central structure from a water inlet 53 at the rear end of the lance through to the front end nose 35 of the central structure and an annular water return passage 54 defined between the two tubes through which the cooling water returns from nose 35 back through the central structure to a water outlet 55 at the rear end of the lance.

The nose end 35 of central structure 33 comprises an inner copper body 61 fitted within an outer domed nose shell 62 also formed of copper. The inner copper piece 61 is formed with a central water flow passage 63 to receive water from the central passage 52 of structure 33 and direct it to the tip of the nose. Nose end 35 is formed with projecting ribs 64 which fit snugly within the nose shell 62 to define a single continuous cooling water flow passage 65 between the inner section 61 and the outer nose shell 62. As seen particularly in FIGS. 5 and 6. The ribs 64 are shaped so that the single continuous passage 65 extends as annular passage segments 66 interconnected by passage segments 67 sloping from one annular segment to the next. Thus passage 65 extends from the tip of the nose in a spiral which, although not of regular helical formation, does spiral around and back along the nose to exit at the rear end of the nose into the annular return passage formed between the tubes 51, 52 of central structure 33.

The forced flow of cooling water in a single coherent stream through spiral passage 65 extending around and back along the nose end 35 of central structure ensures efficient heat extraction and avoids the development of "hot spots" on the nose which could occur if the cooling water is allowed to divide into separate streams at the nose. In the illustrated arrangement the cooling water is constrained in a single stream from the time that it enters the nose end 35 to the time that it exits the nose end.

Inner structure 33 is provided with an external heat shield 69 to shield against heat transfer from the incoming hot gas flow in the duct 31 into the cooling water flowing within the central structure 33. If subjected to the very high temperatures and high gas flows required in a large scale smelting installation, a solid refractory shield may provide only short service. In the illustrated construction the shield 69 is formed of tubular sleeves of ceramic material marketed under the name UMCO. These sleeves are arranged end to end to form a continuous ceramic shield surrounding an air gap 70 between the shield and the outermost tube 51 of the central structure. In particular the shield may be made of tubular segments of UMCO 50 which contains by weight 0.05 to 0.12% carbon, 0.5 to 1% silicon, a maximum of 0.5 to 1% manganese, 0.02% phosphorous, 0.02% sulphur, 27 to 29% chromium, 48 to 52% cobalt and the balance essentially of iron. This material provides excellent heat shielding but it undergoes significant thermal expansion at high temperatures. To deal with this problem the individual tubular segments of the heat shield are formed and mounted as shown in FIGS. 7–10 to enable them to expand longitudinally independently of one another while maintaining a substantially continuous shield at all times. As illustrated in those figures the individual sleeves are mounted on location strips 71 and plate supports 72 fitted to the outer tube 51 of central structure 33, the rear end of each shield tube being stepped at 73 to fit over the plate support with an end gap 74 to enable independent longitudinal thermal expansion of each strip. Anti-rotation strips 75 may also be fitted to each sleeve to fit about raised spline strips 76 on tube 52 to prevent rotation of the shield sleeves.

Hot gas is delivered to duct 31 through the gas inlet section 32. The hot gas may be oxygen enriched air provided through heating stoves at a temperature of the order of 1200° C. This air must be delivered through refractory lined ducting and it will pick up refractory grit which can cause severe erosion problems if delivered at high speed directly into the main water cooled section of duct 31. Gas inlet 32 is designed to enable the duct to receive high volume hot air delivery with refractory particles while minimising damage of the water cooled section of the duct. Inlet 31 comprises a T-shaped body 81 moulded as a unit in a hard wearing refractory material and located within a thin walled outer metal shell 82. Body 81 defines a first tubular passage 83 aligned with the central passage of duct 31 and a second tubular passage 84 normal to passage 83 to receive the hot airflow delivered from stoves (not shown). Passage 83 is aligned with the gas flow passage of duct 31 and is connected to it through a central passage 85 in a refractory connecting piece 86 of inlet 32.

The hot air delivered to inlet 32 passes through tubular passage 84 of body 81 and impinges on the hard wearing refractory wall of the thick refractory body 82 which is resistant to erosion. The gas flow then changes direction to flow at right angles down through passage 83 of the T-shaped body 81 and the central passage 85 of transition piece 86 and into the main part of the duct. The wall of passage 83 may be tapered in the forward flow direction so as to accelerate the flow into the duct. It may for example be tapered to an included angle of the order of 7°. The transition refractory body 86 is tapered in thickness to match the thick wall of refractory body 81 at one end and the much thinner refractory lining 48 of the main section of duct 31. It is accordingly also water cooled through an annular cooling water jacket 87 through which cooling water is circulated through an inlet 88 and an outlet 89. The rear end of central structure 33 extends through the tubular passage 83 of gas inlet 32. It is located within a refractory liner plug 91 which closes the rear end of passage 83, the rear end of central structure 33 extending back from gas inlet 32 to the water flow inlet 53 and outlet 55.

The illustrated apparatus is capable of injecting high volumes of hot gas into the smelting vessel 26 at high temperature. The central structure 33 is capable of delivering large volumes of cooling water quickly and directly to the nose section of the central structure and the forced flow of that cooling water in an undivided cooling flow around the nose structure enables very efficient heat extraction from the front end of the central structure. The independent water flow to the tip of the duct also enables efficient heat extraction from the other high heat flux components of the lance. Delivery of the hot air flow into an inlet in which it impacts with a thick wall of a refractory chamber or passage before flowing downwardly into the duct enables high volumes of air contaminated with refractory grit to be handled without severe erosion of the refractory lining and heat shield in the main section of the lance.

What is claimed is:

1. Apparatus for injecting gas into a vessel, including:

a gas flow duct extending from a rear end to a forward end from which to discharge gas from the duct;

an elongate central tubular structure extending within the gas flow duct from its rear end to its forward end;

a plurality of flow directing vanes disposed about the central tubular structure adjacent the forward end of the duct to impart swirl to a gas flow to the forward end of a duct, the forward end of the central structure and the forward end of the duct co-acting together to form an annular nozzle for flow of gas from the duct with swirl imparted by said vanes;

cooling water passages within the central tubular structure for flow of cooling water forwardly through the central structure from its rear end to its forward end and to internally cool that forward end and thence to return back through the central structure to its rear end.

2. Apparatus as claimed in claim 1, wherein the forward end of the duct is formed as a hollow annular tip formation and the gas flow duct includes duct tip cooling water supply and return passages for supply of cooling water forwardly along the duct into the duct tip and return of that cooling water back along the duct.

3. Apparatus as claimed in claim 1, wherein the interior peripheral surface of the duct is lined with refractory material.

4. Apparatus as claimed in claim 1, wherein the central tubular structure defines a central water flow passage for flow of water forwardly through that structure directly to the forward end of the central structure and an annular water flow passage disposed about the central passage for return flow of water from the forward end of the central structure back to the rear end of that structure.

5. Apparatus as claimed in claim 4, wherein the central tubular structure comprises a central tube providing the central water flow passage and a further tube disposed around the central tube to define said annular water flow passage between the tubes.

6. Apparatus as claimed in claim 1, wherein the central structure includes a heat insulating outer shield to retard heat transfer from gas in the gas flow duct into the cooling water passages in the central structure.

7. Apparatus as claimed in claim 6, wherein the heat insulating shield includes a plurality of tubular segments of heat insulating material disposed end to end to form the heat shield as a substantially continuous tube extending from the rear end to the front end of the central structure about an annular air gap disposed immediately within the heat shield.

8. Apparatus as claimed in claim 7, wherein said air gap is formed between the tubular heat shield and the further tube defining the outer wall of the annular water return flow passage.

9. Apparatus as claimed in claim 7, wherein said tubular segments of the heat shield are supported to accommodate longitudinal expansion of each segment independently of the other such segments.

10. Apparatus as claimed in claim 1, wherein the forward end of the central structure includes a domed nose portion provided internally with a single spiral cooling water passage to receive water from the central water flow passage in the central structure at the tip of the nose and direct that water in a single flow around and backwardly along the nose to cool the nose with a single coherent stream of cooling water.

11. Apparatus as claimed in claim 1 and provided with a gas inlet for introduction of hot gas into the rear end of the duct, the gas inlet including a refractory body defining a first tubular gas passage aligned with and extending directly to the rear end of the duct and a second tubular gas passage transverse to the first passage to receive hot gas and direct it to the first passage so that the hot gas and any particles entrained therein impinge on refractory wall of the first passage, the gas flow undergoing a change of direction in passing from the first passage to the second passage.

12. Apparatus as claimed in claim 11, wherein the first and second gas flow passages are essentially normal to one another.

13. Apparatus as claimed in claim 11, wherein the central tubular structure extends centrally through the first gas flow passage of the gas inlet and rearwardly beyond the gas inlet.

14. Apparatus as claimed in claim 13, wherein the rear end of the central structure is located rearwardly of the gas inlet and is provided with water couplings for the flow of cooling water to and from the central structure.

15. Apparatus for injecting gas into a vessel, including:

a gas flow duct extending from a rear end to a forward end from which to discharge gas from the duct;

an elongate structure extending centrally within the forward end of the duct such that gas flowing through the forward end of the duct will flow over and along the central structure;

a plurality of flow directing vanes disposed about the central structure adjacent the forward end of the duct to impart swirl to a gas flow to the forward end of a duct, the forward end of the central structure and the forward end of the duct co-acting together to form an annular nozzle for flow of gas from the duct with swirl imparted by said vanes; and a cooling water passage within the central structure for flow of cooling water forwardly to its forward end and to internally cool that forward end;

wherein the forward end of the central structure includes a domed nose portion provided internally with a single spiral cooling water passage to receive water from the central water flow passage in the central structure at the tip of the nose and direct that water in a single flow around and backwardly along the nose to cool the nose with a single coherent stream of cooling water.

16. Apparatus as claimed in claim 15, wherein the cooling water passage within the central structure extends centrally along the central structure to the tip of the nose and the central structure is further provided with an annular water flow passage disposed about central passage to receive said single coherent stream of cooling water from the nose for return flow of that water back through the central structure.

17. Apparatus for injecting gas into a vessel, including:

a gas flow duct extending from a rear end to a forward end from which to discharge gas from the duct;

an elongate structure extending centrally within the forward end of the gas flow duct such that gas flowing through the forward end of the duct will flow over and along the central structure;

a plurality of flow directing vanes disposed about the central tubular structure adjacent the forward end of the duct to impart swirl to a gas flowing to the forward end of a duct, the forward end of the central structure and the forward end of the duct co-acting together to form an annular nozzle for flow of gas from the duct with swirl imparted by said vanes;

cooling water passages within the wall of the duct and the central structure for water cooling both the duct and the central structure; and a gas inlet for introduction of hot gas into the rear end of the duct, the gas inlet comprising a refractory body defining a first tubular gas passage aligned with and extending directly to the rear end of the duct and a second tubular gas passage transverse to the first passage to receive hot gas and direct it to the first passage so that the hot gas and any particles entrained therein impinge on refractory wall of the first passage, the gas flow undergoing a change of direction in passing from the first passage to the second passage.

18. Apparatus as claimed in claim 17, wherein the first and second gas flow passages are essentially normal to one another.

19. Apparatus as claimed in claim 17, wherein the elongate structure extends centrally through the first gas flow passage of the gas inlet and rearwardly beyond the gas inlet.

20. Apparatus as claimed in claim 19, wherein the rear end of the central elongate structure is located rearwardly of the gas inlet and is provided with water couplings for the flow of cooling water to and from the cooling water passages in the central structure.

21. A metallurgical vessel fitted with apparatus for injecting a flow of gas into an upper part of the vessel under high temperature conditions, said apparatus being constructed in accordance with claim 1 and being mounted in a roof of the vessel to extend downwardly through the roof with the rear end of the gas flow duct disposed above the roof and the forward end of the duct located in the upper part of the vessel.

22. A metallurgical vessel fitted with apparatus for injecting a flow of gas into an upper part of the vessel under high temperature conditions, said apparatus being constructed in accordance with claim 15 and being mounted in a roof of the vessel to extend downwardly through the roof with the rear end of the gas flow duct disposed above the roof and the forward end of the duct located in the upper part of the vessel.

23. A metallurgical vessel fitted with apparatus for injecting a flow of gas into an upper part of the vessel under high temperature conditions, said apparatus being constructed in accordance with claim 17 and being mounted in a roof of the vessel to extend downwardly through the roof with the rear end of the gas flow duct disposed above the roof and the forward end of the duct located in the upper part of the vessel.

* * * * *

UNITED STATES PATENT AND TRADEMARK OFFICE

CERTIFICATE OF CORRECTION

PATENT NO. : 6,673,305 B2
DATED : January 6, 2004
INVENTOR(S) : Martin Joseph Dunne et al.

It is certified that error appears in the above-identified patent and that said Letters Patent is hereby corrected as shown below:

Title page,
Item [*] Notice, the following should also appear:
-- This patent is subject to a terminal disclaimer. --

Column 4,
Line 66, "FIGS. 2-10" should read -- FIGS. 2-9 --.

Figure 4:
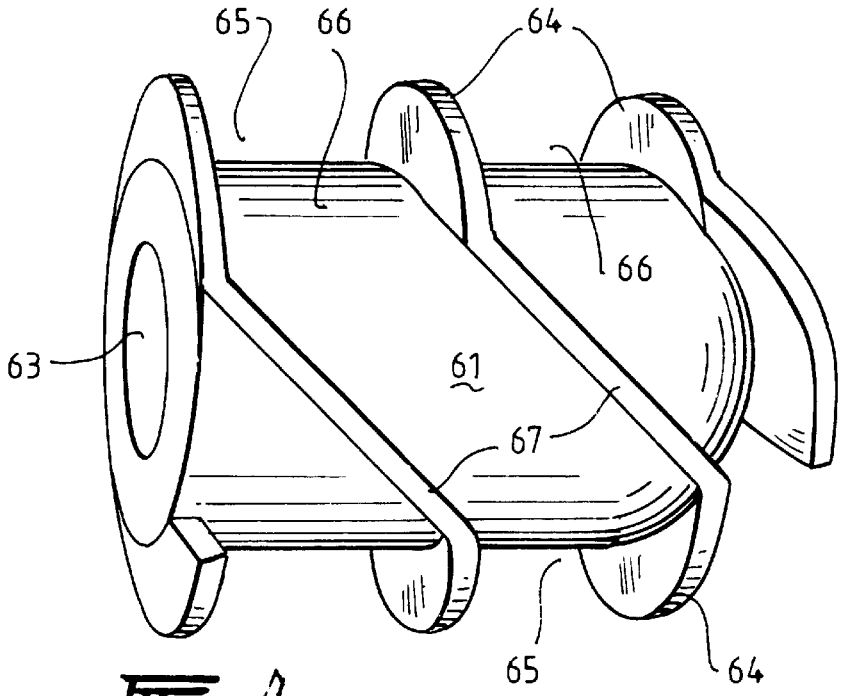
FIGS. 4 and 5 illustrate the construction of a forward nose end of the central structure.
Figure 5:
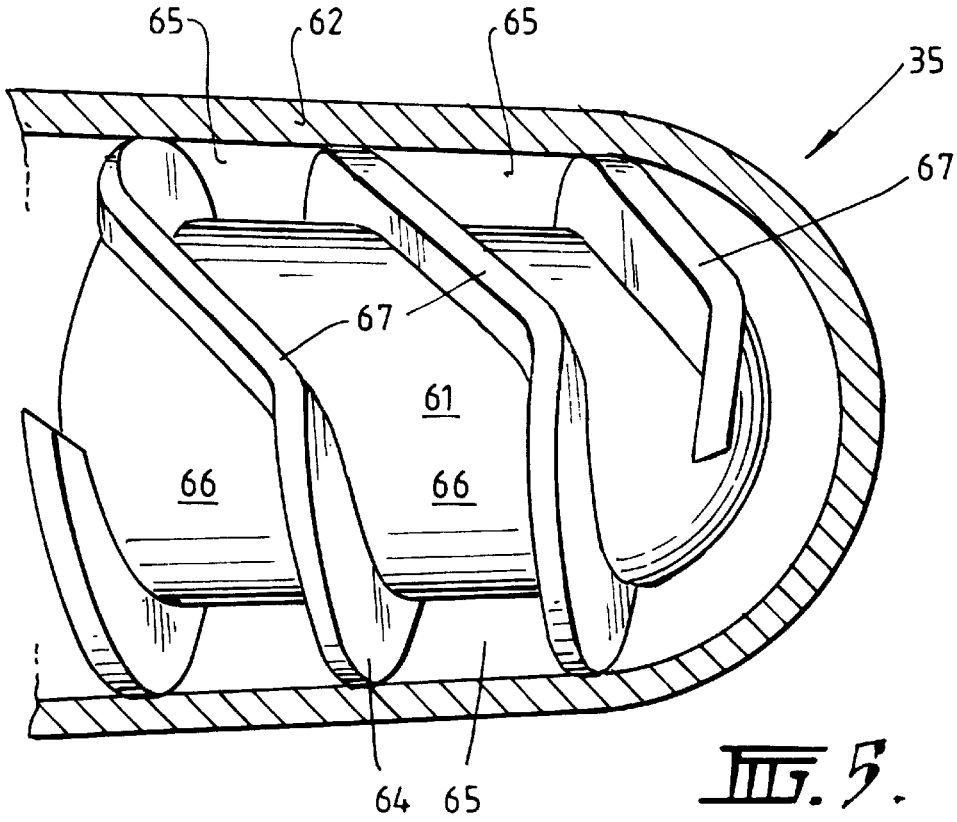
Figure 6:
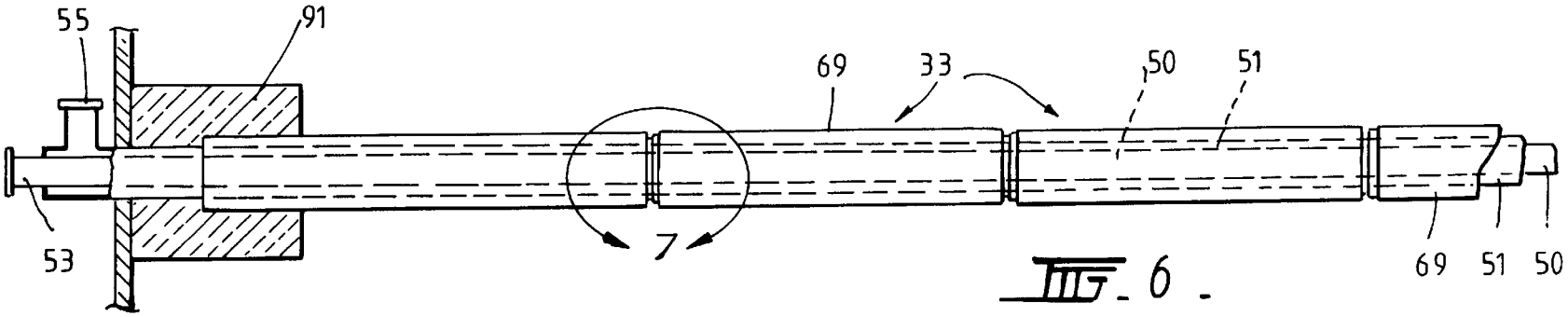
FIG. 6 is a longitudinal cross-section through the central structure.
Figure 9:
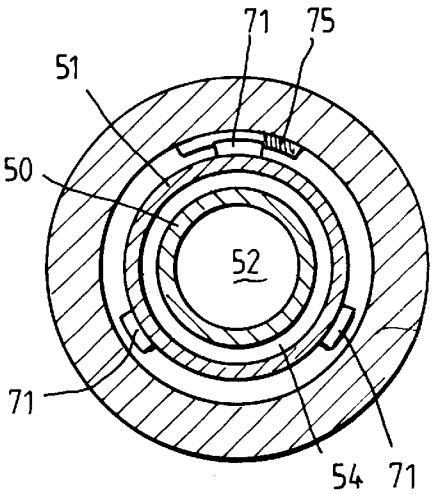
FIG. 9 is a cross-section on the line 9—9 in FIG. 7.
Figure 8:
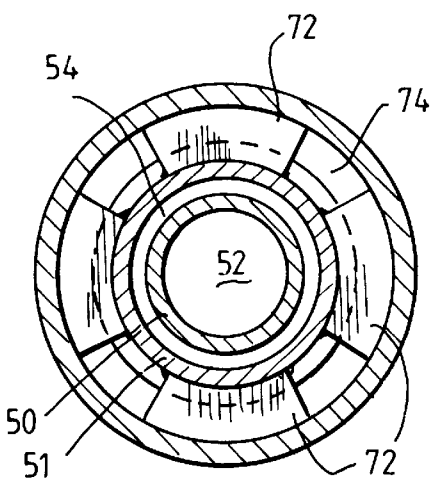
FIG. 8 is a cross-section on the line 8—8 in FIG. 7.
Figure 7:
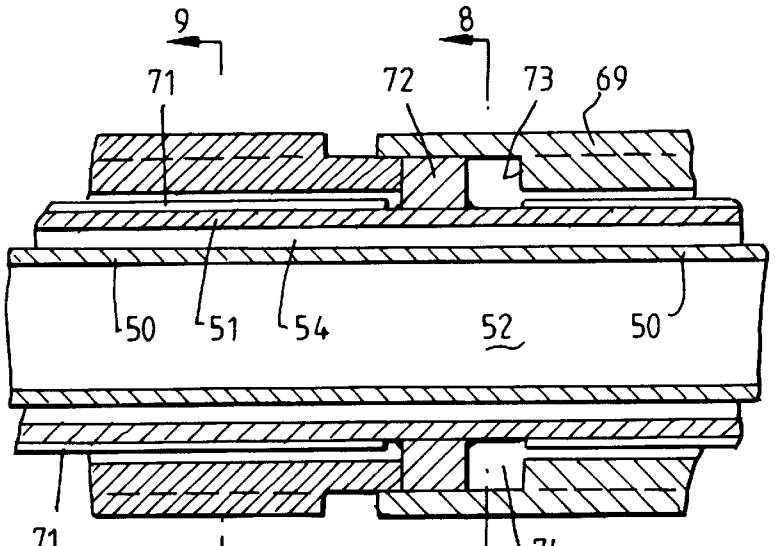
FIG. 7 shows a detail in the region 7 of FIG. 6.

Column 6,
Line 8, "FIGS. 5 and 6" should read -- FIGS. 4 and 5 --.
Line 46, "FIGS. 7-10" should read -- FIGS. 6-9 --.
Lines 54-55, "sleeve to fit about raised spline strips 76 on tube 52 to", should read -- sleeve to fit about one of the location strips 71 on tube 52 to --.

Signed and Sealed this

Sixth Day of April, 2004

JON W. DUDAS
*Acting Director of the United States Patent and Trademark Office*